US006398156B2

(12) United States Patent
Hetzer et al.

(10) Patent No.: US 6,398,156 B2
(45) Date of Patent: Jun. 4, 2002

(54) MOUNTING FOR ATTACHING A RUDDER TO A MISSILE

(75) Inventors: Walter Hetzer, Grasbrunn; Ernst Lenz, Kirchseeon, both of (DE)

(73) Assignee: LFK Lenkflugkoerpersysteme GmbH, Unterschleissheim (DE)

( * ) Notice: Subject to any disclaimer, the term of this patent is extended or adjusted under 35 U.S.C. 154(b) by 0 days.

(21) Appl. No.: 09/735,163

(22) Filed: Dec. 12, 2000

(30) Foreign Application Priority Data

Dec. 16, 1999 (DE) ..... 199 60 738

(51) Int. Cl.[7] ..... F42B 10/02

(52) U.S. Cl. ..... 244/3.24; 244/3.28; 244/3.29; 244/3.3

(58) Field of Search ..... 244/3.24, 3.25, 244/3.26, 3.27, 3.28, 3.29, 3.3, 50, 51, 52, 220, 234, 235, 87, 88, 89, 90 R, 90 A, 90 B

(56) References Cited

U.S. PATENT DOCUMENTS 3,650,496 A * 3/1972 Svensson ..... 244/3.29
3,861,627 A * 1/1975 Schoffl ..... 244/3.27
3,880,383 A * 4/1975 Voss et al. ..... 244/3.27
3,921,937 A * 11/1975 Voss et al. ..... 244/3.27
6,202,958 B1 * 3/2001 Dommer et al. ..... 244/3.28
6,220,544 B1 * 4/2001 Dommer et al. ..... 244/3.28

FOREIGN PATENT DOCUMENTS

DE 3441534 5/1986
DE 19635847 3/1998

* cited by examiner

*Primary Examiner*—Bernarr E. Gregory
(74) *Attorney, Agent, or Firm*—W. F. Fasse; W. G. Fasse

(57) ABSTRACT

A rudder of a missile, particularly an aircraft born ramjet missile, is attached to the missile by a plug and socket mounting. A bearing socket (B1) is attached to a base plate (B0) which is secured to the missile body (FK). The socket (B1) has a conical cavity (B3) tapering toward the base plate (B0). The plug (W1) is formed by a rudder shaft (W) also tapering toward the base plate and rotatably fitting into the conical cavity (B3). Bearings (L1, L2) in the cavity (B3) hold the plug end (W1) of the rudder shaft axially and permit rotation of the rudder shaft (W) relative to the bearing socket (B1). The socket thus holds the bearings and has an at least partly outer cylindrical contour with a diameter (B2) that fits into a standard 41 mm wide slot (S) in an aircraft that carries the missile, whereby the rudder (R) is recessed in the slot (S) when the missile is mounted to an aircraft.

12 Claims, 2 Drawing Sheets

MOUNTING FOR ATTACHING A RUDDER TO A MISSILE

PRIORITY CLAIM

This application is based on and claims the priority under 35 U.S.C. §119 of German Patent Application 199 60 738.9, filed on Dec. 16, 1999, the entire disclosure of which is incorporated herein by reference.

FIELD OF THE INVENTION

The invention relates to a mounting for attaching a rudder to a missile, particularly a guided missile driven by a ramjet and carried by an aircraft. A rudder blade is mounted to a rudder shaft which in turn is secured to an interface fitting referred to as a "mounting" attachable to the missile body. The rudder blade is turnable by a rudder actuating lever.

BACKGROUND INFORMATION

German Patent Publication DE 196 35 847 C2 describes a mounting as mentioned above. Power for operating the rudder actuating lever is transmitted from a power source through a coupling rod with a bearing at each end of the rod. The available space is not used efficiently and conventional thermal stress characteristics and mechanical stress characteristics leave room for improvement. Similar considerations apply with regard to reloading the same aircraft with missiles, particularly different missile types.

German Patent Publication DE 34 41 534 C2 discloses a bearing for a rudder blade of a guided flying body that is launched from a firing tube. The rudder is mounted in the tail end of the flying body, whereby the mounting requires a seal for protecting the rudder bearing against propulsion gases. The sealing pressure is adjustable by set screws. Such a mounting is not suitable for connecting a rudder to a missile carried by an aircraft.

Modern combat aircraft carry medium range guided missiles mainly in a partially recessed arrangement in the fuselage to reduce air drag and to favorably influence the radar signature of the combat aircraft.

The shape or configuration of the airplane missile interface where the missile or rocket is mounted to the aircraft is determined by the currently accepted air to air guided missile known as AMRAAM. The configuration of the AMRAAM rudder mounting was also used in the prototypes of the EF 2000 Euro fighter aircraft. For mounting the missile or rocket to the aircraft slotted recesses 41 mm wide are provided in the airplane fuselage for accepting the rudder and wings of the AMRAAM missile when the missiles are mounted to the aircraft.

In a case of AMRAAM trailing missiles driven by a ramjet, the rudder must be mounted outside the missile body because the interior is almost completely taken up by the ramjet combustor or combustion chamber. This requirement generally leads to a voluminous mounting outside of the missile body that may be incompatible with the aircraft interface determined by the AMRAAM missile.

It is not sufficient to place the missile rudder contact free in the 41 mm wide recess of the aircraft fuselage. The required minimum free space of several millimeters between the aircraft body and the rocket or missile must be maintained on all sides between the rudder and the wall of the recess.

The desire for using exchangeable ramjet driven missiles on the same aircraft interface is therefore problematic in conventional rudder mounting configurations.

OBJECTS OF THE INVENTION

In view of the above it is the aim of the invention to achieve the following objects singly or in combination:

- to provide a rudder mounting for attaching a rudder to an aircraft borne missile, particularly a guided missile that fulfils the spatial requirements while simultaneously efficiently taking up the mechanical and thermal stresses that arise at cruising speeds of Mach IV;
- to make sure that the minimal spacing between the slot walls in the aircraft body and the missile or rocket is maintained at all times;
- to provide a rudder to rocket mounting interface that permits quick reloading of missiles even under adverse field conditions;
- to permit quick reloading even when using exchangeable different rockets or missiles;
- to permit mounting the rocket rudder to the missile by using standard tools and even under adverse field conditions; and
- to construct a missile rudder mounting in such a way that bending loads at the rudder connecting point of the mounting are reduced or even minimized.

SUMMARY OF THE INVENTION

The mounting for attaching a rudder to a missile according to the invention is characterized by an interface fitting simply referred as "mounting" including a base plate for securing the rudder to the missile. The mounting further comprises a bearing socket secured to the base plate. The bearing socket has a conical cavity with a small cavity diameter next to the base plate and a large cavity diameter at a socket outer end facing the rudder. The mounting further includes a rudder shaft for rotatably securing the rudder through the socket to the base plate. The rudder shaft has a conical rudder shaft section having a small cone diameter next to the base plate and a large cone diameter next to the socket outer end. The conical rudder shaft section is rotatably received in the conical cavity, whereby the conical rudder shaft section and the conical cavity taper toward the base plate. Bearings are mounted in the socket and rotatably hold the conical rudder shaft section in the conical cavity of the socket.

A radially outer end of the rudder shaft for holding a rudder blade is provided with a fork configuration having two prongs forming a gap in which a blade foot of the rudder is mounted. The radially outer end of the rudder shaft formed by the two prongs is preferably also conical.

The outer configuration of the bearing socket is at least partially cylindrical and has such an outer diameter that it fits with the required all around spacing into the above-mentioned slot in an aircraft carrying the missile.

BRIEF DESCRIPTION OF THE DRAWINGS

In order that the invention may be clearly understood, it will now be described in connection with an example embodiment, with reference to the accompanying drawings, wherein.

DETAILED DESCRIPTION OF PREFERRED EXAMPLE EMBODIMENTS AND OF THE BEST MODE OF THE INVENTION

Figure 1:
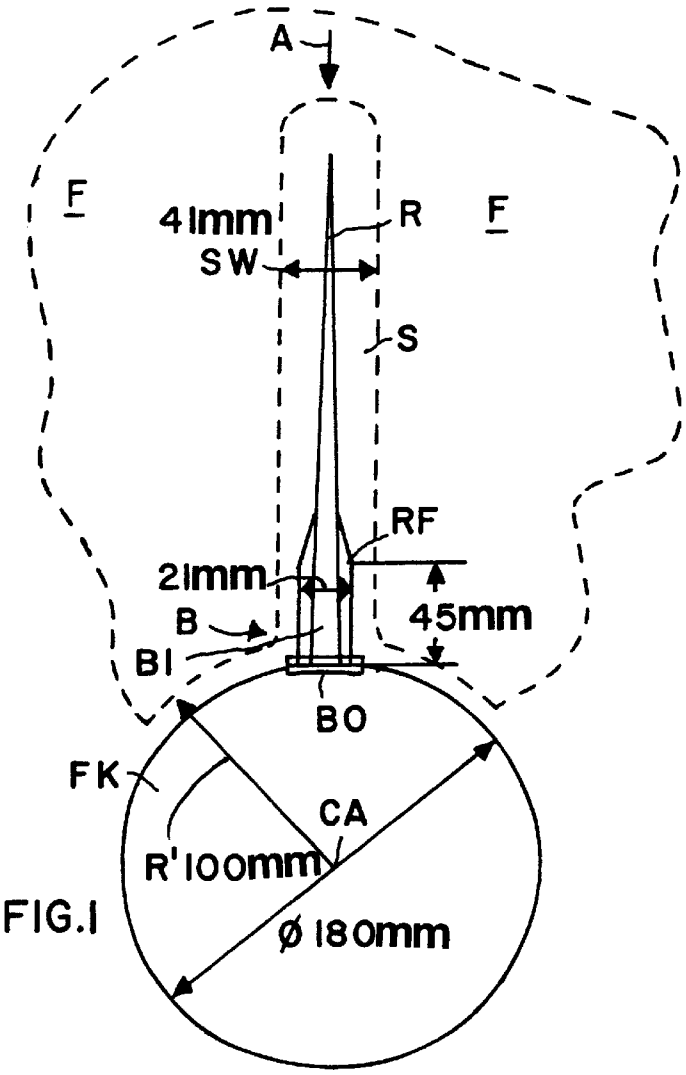
FIG. 1 is a view in the direction of the longitudinal missile axis illustrating schematically the position of a missile rudder in a slot in an aircraft carrying the missile.

FIG. 1 shows schematically a missile body FK mounted to an aircraft of which only a broken-away portion F is shown. The aircraft portion F may be part of an aircraft fuselage or a wing and has a slot S in which a rudder R of the missile body FK is received or enclosed. The slot S has a standardized width SW of 41 mm. The rudder R is secured to the missile body FK by a mounting B according to the invention including a base plate BO and a bearing socket B1 as will be described in more detail below. The rudder R has a rudder foot RF with an outer diameter of 21 mm, thus leaving a spacing between the rudder foot RF and the inner wall of the slot S all around the rudder and rudder foot. The mounting B has an axial length of 45 mm, for example. The missile body has a diameter, for example of 180 mm and a radial distance R' from the central axis CA of the missile body FK to the surface of the aircraft portion F of R'=100 mm for example, thereby also leaving the required gap between the aircraft surface and the surface of the missile body FK. The missile is, for example of the AMRAAM type.

To provide the required exchangeability of missiles the exchangeable missiles must be compatible with the just described mounting environment. More specifically, the rudder must fit in the respective slot S with its width SW of 41 mm.

Figure 2C:
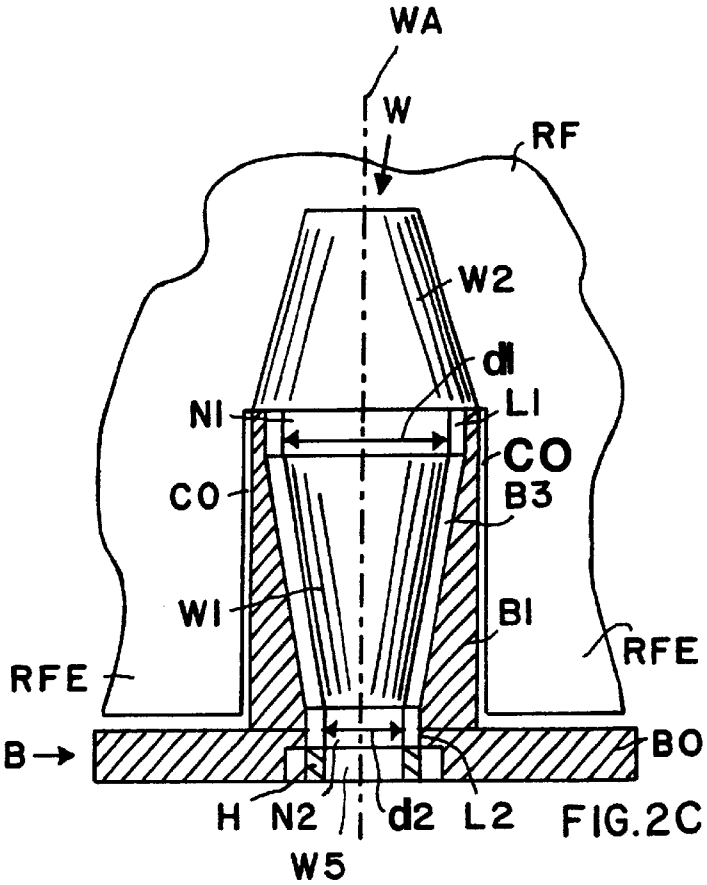
FIG. 2*c* is a sectional view along section plane IIC—IIC in FIG. 2A on a scale somewhat enlarged relative to FIG. 2B and showing, broken-away, rudder blade foot extension with a cut-out in which a bearing socket of the mounting is received.
Figure 2B:
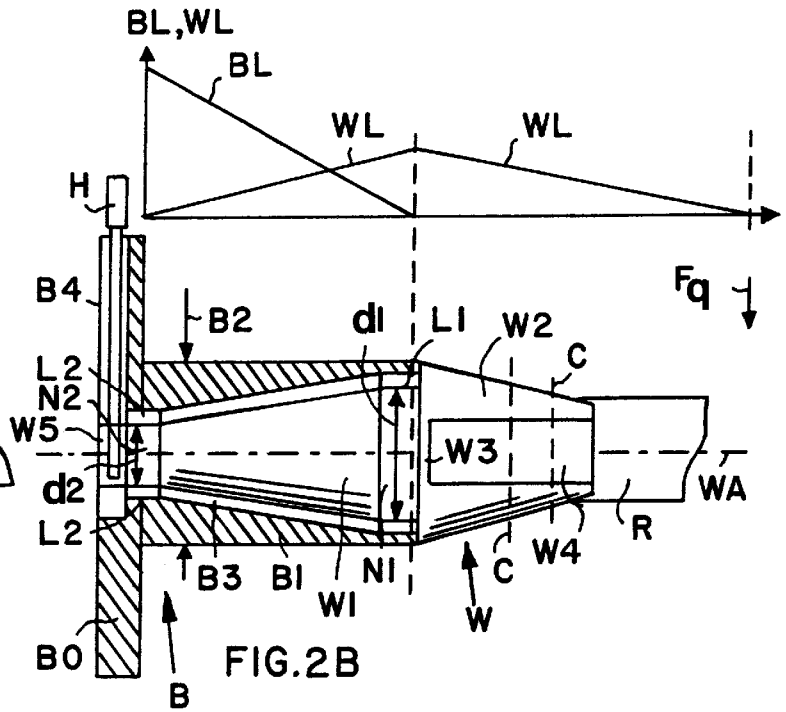
FIG. 2*b* is a sectional view along section line IIB—IIB in FIG. 2A showing a drive lever for the rudder and the bending moments effective on the present rudder mounting.
Figure 2A:
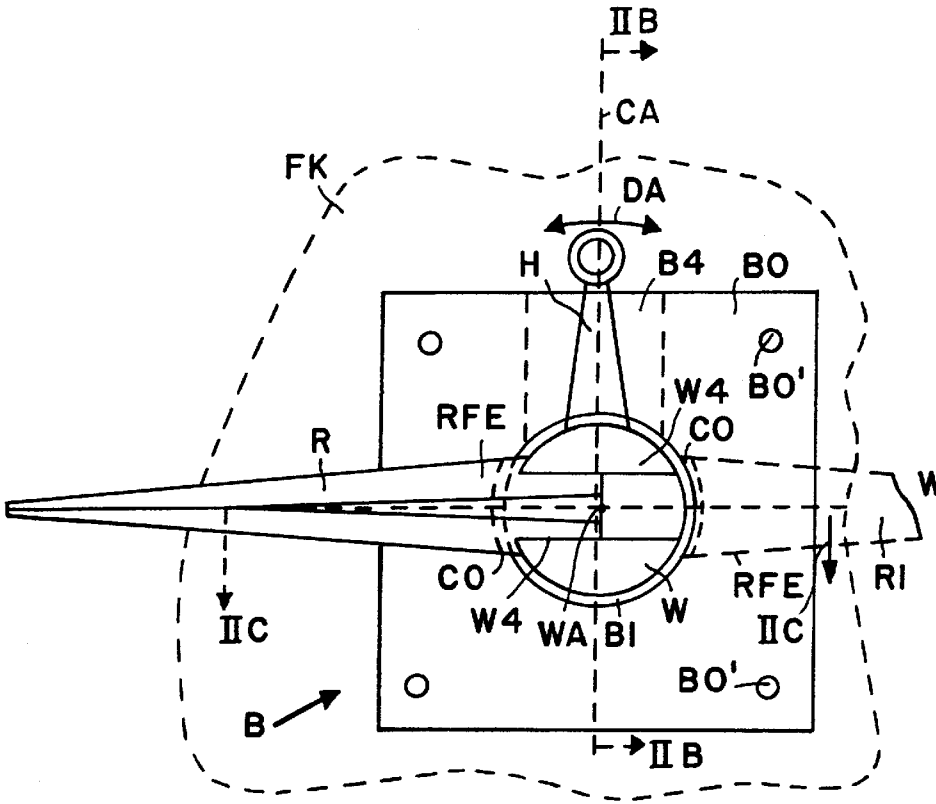
FIG. 2*a* is a view in the direction of the arrow A in FIG. 1 showing a plan view of the present rudder mounting with its base plate attached to a missile body.

Referring to FIGS. 2*a*, 2*b* and 2*c* in conjunction, these Figs. illustrate a rudder mounting B according to the invention that is compatible with an AMRAAM missile and simultaneously useful for securing a rudder to a missile driven by a ramjet. The present mounting B may also be used for other missile types to provide for the desired changeability.

FIG. 2*a* shows a view in which the longitudinal rudder axis WA extends perpendicularly to the plane of the drawing sheet and perpendicularly to the longitudinal axis CA of the missile body FK.

The mounting B according to the invention comprises a base plate B0 secured to the missile body FK by conventional mounting elements B0' such as screws or rivets or the like. Only the left portion of the rudder R is shown in full lines in FIG. 2*a* while the right-hand portion R1 is shown in dashed lines. The present mounting B further comprises a rudder shaft W partially received in a bearing socket B1 secured to the base plate B0. The rudder shaft has a forked end W2 with two prongs forming a gap W4 with a saddle W3 best seen in FIG. 2*b* in which a rudder blade foot RF seen in FIG. 2*c*, is received and secured by conventional securing elements or connectors C such as screws, locking pins, or the like C.

The rudder blade foot RF has a cut-out CO so dimensioned that the bearing socket B1 can be received in the cut-out CO as best seen in FIG. 2*c*. For this purpose, the bearing socket B1 preferably has an at least partially cylindrical outer configuration with a diameter B2 slightly smaller than the width of the cut-out CO to leave sufficient clearance for rotating the rudder R relative to the bearing socket B by operating a drive lever H as indicated by the double arrow DA in FIG. 2*a*. The drive for operating the rudder is conventional and hence not shown.

Referring particularly to FIGS. 2*b* and 2*c* the bearing socket B1 of the present mounting B has the above mentioned outer diameter B2 and a conical cavity B3. The conical cavity B3 tapers toward the base plate B0. The socket B1 has a bore coaxial to the rudder axis WA. The bore forms a small diameter end of the cavity B3. The radially outer end of the cavity B3 facing the rudder R has a large diameter forming a cylindrical cavity section wherein a large diameter bearing L1 is received. A small diameter bearing L2 is received in the small diameter bore of the socket B1, whereby the bore merges into a respective coaxial bore in the base plate B0 to hold a small diameter bearing L2. A rudder shaft W has a conical inner section W1 positioned in the cavity B3 and an outer section W2 which preferably is also conical, but not necessarily. The outer section W2 extends out of the cavity B3 to hold the rudder blade foot RF, for example in the gap W4 formed between two tapering sides or prongs which form an outward conical taper. The gap W4 has a bottom forming the saddle W3 on which the rudder blade foot RF rests.

The two rudder shaft sections W1 and W2 are interconnected by a large diameter neck N1 having a diameter d1. The large diameter bearing L1 is mounted on the neck N1. The opposite small diameter end of the tapering section W1 of the rudder shaft W has a cylindrical small diameter neck N2 with a smaller diameter d2 on which the small diameter bearing L2 is mounted. A neck extension projects out of the bearing L2 to form a drive end W5 of the rudder shaft W. The projecting drive end W5 extends from the neck N2 into a recess B4 of the base plate B0. The above mentioned drive lever H is received in the recess B4 of the base plate B0 and is rigidly connected to the drive end W5 of the rudder shaft W for rotating the rudder by any conventional drive suitable for the purpose.

Referring to FIG. 2*b*, the just described construction of the conical bearing socket recess B3 and the conical section W1 of the rudder shaft W provide an advantageous distribution of the bending moments BL and WL effective on the present mounting B. The bending moment BL is effective on the bearing socket B1 while the bending moment WL is effective on the rudder shaft W. These bending moments BL and WL are caused by forces Fq exerted by the air flow on the rudder surfaces. These forces Fq are shown as an arrow Fq in FIG. 2*b*. This distribution of the bending moments is very beneficial because the larger bending moment BL is directly introduced into the base plate B0 at the thick end of the bearing socket B1. Thus, the dimensions of the present mounting B are effectively adapted to taking up the bending moments BL and WL illustrated in FIG. 2*b*.

The bearings L1 and L2 received in the bearing socket B1 are preferably ceramic needle bearings, at least one of which is so constructed as to take up any possibly occurring axial forces effective in the direction of the rudder axis WA radially outwardly. The large diameter bearing L1 has preferably an inner diameter of d1 of 22 mm while the smaller diameter bearing L2 has preferably an inner diameter d2 of 12 mm, whereby the bearings are adapted to the bending load exerted by the bending moment WL to which the rudder shaft W is exposed.

Referring to FIGS. 2*b* and 2*c* in conjunction, the rudder R has a rudder foot RF with a cut-out CO. The cut-out CO has an axial length slightly smaller than the axial length of the bearing socket B1. Further, as mentioned, the bearing socket B1 has a diameter B2 slightly smaller than the width of the cut-out CO to provide the required clearance for the relative rotation of the rudder R relative to the socket B1 and relative to the base plate B0. The rudder foot RF is received in the gap W4 and rests against the saddle W3 as mentioned to assure the axial spacing between the base plate B0 and the inner ends of the rudder foot extensions RFE. The rudder foot RF is rigidly secured by connectors C in the gap W4, as mentioned above.

The radially inner end of the drive lever H is, for example, secured in a form locking manner to the drive end W5 of the rudder shaft W.

The rudder mounting B according to the invention has the following advantages. The invention minimizes the dimensions of the bearing socket B1 and the rudder shaft W while simultaneously adapting the dimensions to the maximum bending load that can occur. Specifically, the socket B1 has a thick dimension next to the base plate B0 where its bending load caused by the bending moment BL is largest. Similarly, the rudder shaft W has its largest effective dimension where the maximum of the bending load occurs caused by the bending moment WL.

Further, the main components such as the base plate B0, the bearing socket B1 and the rudder shaft W are so-configured that they can be manufactured in a cost efficient manner by simple machining operations. This simple plug and socket configuration also facilitates the mounting of the rudder R in the socket B1 and the socket B1 to the base plate B0 and the base plate B0 to the missile body FK.

The present mounting B has the further advantage that the aerodynamic heating that occurs at speeds up to Mach IV causing a high thermal loading, results in a homogeneous heat distribution in the just mentioned main components of the present mounting. Such a uniform heat distribution or uniform heating permits the advantageous use of cost effective high temperature resistant ceramic needle bearings L1 and L2.

Forming the outer end W2 of the rudder shaft W as a forked configuration with the gap W4 facilitates the manufacture as well as the rapid mounting of the rudder blade in the socket W4 even under adverse conditions in the field, whereby standard tools can be used.

The arrangement and position of the gap W4 in which the rudder blade foot RF is mounted connects the rudder blade to the rudder shaft W at the center of pressure of the rudder blade so that the base bending moments are small at the clamping or bearing point.

Yet another advantage is seen in the fact that a sealing between the missile body FK and the present mounting B can be simply arranged between the base plate B0 and the outer surface of the missile body FK. The same applies with regard to the rudder drive lever H, thereby obtaining a perfect sealing since the location of the relative motion between the rudder shaft W and the bearing socket B1 is removed from the missile body FK or rather separated from the missile body FK by the base plate B0.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for attaching a rudder to a missile, said apparatus comprising a mounting (B) including a base plate (B0) for securing said rudder (R) to said missile (FK), said mounting further comprising a bearing socket (B1) secured to said base plate (B0), said bearing socket having a conical cavity (B3) with a small cavity diameter next to said base plate (B0) and a large cavity diameter at an outer end of said bearing socket (B1), said apparatus further comprising a rudder shaft (W) for rotatably securing said rudder through said bearing socket (B1) to said base plate (B0), said rudder shaft (W) having a conical rudder shaft section (W1) having a small cone diameter next to said base plate and a large cone diameter next to said socket outer end, wherein said conical rudder shaft section (W1) is rotatably received in said conical cavity (B3), whereby said conical rudder shaft section (W1) and said conical cavity (B3) taper toward said base plate (B0), and bearings (L1, L2) mounted in said bearing socket (B1), said bearings (L1, L2) rotatably holding said conical rudder shaft section (W1) in said conical cavity (B3) of said socket (B1).

2. The apparatus of claim 1, further comprising a central rudder axis (WA) extending lengthwise through said rudder shaft (W), through said socket (B1) and through said base plate (B0), said socket (B1) having a first bore next to said base plate, said base plate (B0) having a second bore next to said first bore so that said first and second bores are coaxial to said central rudder axis (WA), a recess (B4 in said base plate (B0) communicating with said first and second bores, said rudder shaft (W) comprising a drive end (W5) extending through said first and second bores into said recess (B4) in said base plate (B0), a rudder shaft drive lever (H) rotatable in said recess and rigidly secured to said drive end (W5) of said rudder shaft (W) for rotating said rudder (R) through said rudder shaft (W) by rotating said drive lever (H) in said recess (B4) of said base plate (B0).

3. The apparatus of claim 1, wherein said rudder shaft (W) comprises a further shaft section (W2) extending out of said conical cavity (B3) of said bearing socket (B1), said further shaft section (W2) forming a fork with a gap (W4) for securing said rudder (R) to said rudder shaft (W).

4. The apparatus of claim 3, wherein said further shaft section (W2) has a configuration tapering away from said bearing socket (B1) toward said rudder (R).

5. The apparatus of claim 3, further comprising a rudder (R) including a rudder foot (RF), a cut-out (CO) forming rudder foot extensions (RFE) in said rudder foot (RF), said rudder foot (RF) extending into said gap (W4), said cut-out extending along said bearing socket (B1) so that said rudder foot extensions (RFE) reach toward said base plate (B0) without contacting said base plate (B0).

6. The apparatus of claim 1, wherein said bearings are ceramic needle bearings.

7. The apparatus of claim 1, wherein said bearing socket (B1) comprises an outer configuration that is at least partly cylindrical having an outer diameter (B2), said apparatus further comprising a rudder blade with a cut-out (CO) facing said bearing socket (B1), said outer diameter (B2) of said socket fitting into said cut-out with a clearance between said bearing socket (B1) and said rudder blade.

8. The apparatus of claim 7, wherein said outer diameter (B2) of said bearing socket (B1) is dimensioned to fit into a standard slot (S) in an aircraft (F) carrying said missile.

9. The apparatus of claim 1, wherein said bearings (L1, L2) comprise a large diameter bearing (L1) mounted in said cavity (B3) at said large cavity diameter at said outer end of said bearing socket (B1), and a small diameter bearing (L2) mounted in said cavity (B3) at said small cavity diameter next to said base plate (B0).

10. The apparatus of claim 1, wherein said rudder shaft (W) comprises a further shaft section (W2) extending out of said conical cavity (B3) for securing said rudder (R) to said rudder shaft (W), said rudder shaft (W) comprising a first large diameter cylindrical neck (N1) between said conical rudder shaft section (W1) and said further shaft section (W2), said bearings comprising a first large diameter bearing (L1) mounted on said first large diameter cylindrical neck (N1), said rudder shaft (W) further comprising a second small diameter cylindrical section (W5) forming a drive end of said rudder shaft, said bearings comprising a second small diameter bearing (L2) mounted on said small diameter cylindrical section (W5), said bearing socket (B1) and said base plate (B0) comprising a bore in which said second small diameter bearing (L2) is received.

11. The apparatus of claim 10, wherein said drive end (W5) projects into a recess (B4) of said base plate (B0), said apparatus further comprising a drive lever (H) rigidly connected to said drive end (W5) of said rudder shaft (W), and wherein said drive lever (H) is rotatable in said recess (B4).

12. The apparatus of claim 11, wherein said first and second bearings are ceramic needle bearings.

* * * * *